US008342968B2

(12) United States Patent
Fuccillo et al.

(10) Patent No.: US 8,342,968 B2
(45) Date of Patent: Jan. 1, 2013

(54) METHODS AND SYSTEM FOR IMPROVING A USER'S REACTION TIME AND ACCURACY IN PROPELLING AN OBJECT

(76) Inventors: Ralph C. Fuccillo, Eastport, NY (US); Andrew P. Brosky, Hughesville, MD (US)

( * ) Notice: Subject to any disclaimer, the term of this patent is extended or adjusted under 35 U.S.C. 154(b) by 972 days.

(21) Appl. No.: 12/071,723

(22) Filed: Feb. 26, 2008

(65) Prior Publication Data

US 2009/0197708 A1 Aug. 6, 2009

Related U.S. Application Data

(60) Provisional application No. 61/006,835, filed on Feb. 1, 2008.

(51) Int. Cl.
*A63F 9/24* (2006.01)

(52) U.S. Cl. ..... 463/49; 463/50; 463/51

(58) Field of Classification Search ..... 463/49, 463/50, 51
See application file for complete search history.

(56) References Cited

U.S. PATENT DOCUMENTS

| | | | | |
|---|---|---|---|---|
| 4,607,842 | A | 8/1986 | Daoust | |
| 4,702,475 | A | 10/1987 | Elstein et al. | |
| 4,751,642 | A | 6/1988 | Silva et al. | |
| 5,509,650 | A | 4/1996 | MacDonald | |
| 5,882,204 | A | 3/1999 | Iannazo et al. | |
| 6,003,867 | A * | 12/1999 | Rodesch et al. | 273/143 R |
| 6,430,997 | B1 | 8/2002 | French et al. | |
| 6,828,994 | B2 * | 12/2004 | Oka et al. | 715/858 |
| 6,918,845 | B2 | 7/2005 | Kudla | |
| 6,926,624 | B1 | 8/2005 | Witzke | |
| 7,134,976 | B1 | 11/2006 | Smith | |
| 7,166,045 | B1 | 1/2007 | Linner et al. | |
| 2002/0137493 | A1 * | 9/2002 | Dutta | 455/414 |
| 2004/0051788 | A1 * | 3/2004 | Oka et al. | 348/211.99 |
| 2010/0174783 | A1 * | 7/2010 | Zarom | 709/205 |
| 2010/0285883 | A1 * | 11/2010 | Zalewski | 463/39 |

* cited by examiner

*Primary Examiner* — Pierre E Elisca
(74) *Attorney, Agent, or Firm* — Maier & Maier PLLC

(57) ABSTRACT

A method of conveying a command to a user using a practice system is provided. The method includes detecting movement of the user using a sensor; selecting a command from a list of pre-determined commands; and conveying the command to the user using a signaler.

10 Claims, 3 Drawing Sheets

METHODS AND SYSTEM FOR IMPROVING A USER'S REACTION TIME AND ACCURACY IN PROPELLING AN OBJECT

CROSS-REFERENCE TO RELATED APPLICATIONS

This application claims priority to U.S. Provisional Application Ser. No. 61/006,835, filed Feb. 1, 2008 and entitled VIRTUAL COACH, the entire contents of which are hereby incorporated by reference.

BACKGROUND OF THE INVENTION

This application relates generally to athletic practice training equipment, and more particularly, to equipment used to improve a player's reaction time and accuracy of propelling an object.

Many athletic activities include a player propelling an object, or projectile, towards a target such as a structure or another player. The speed and accuracy at which the player reacts and propels the projectile toward the target generally determines the effectiveness of that player in the outcome of an actual athletic competition. A player that reacts faster in deciding which target option to propel the projectile towards and propels the projectile towards the chosen target with high accuracy, is generally more effective than a player that has a slower reaction time and/or a lower accuracy. As a result, it is important that players practice in a manner that simulates competition-like events to facilitate improving the player's reaction time and accuracy in propelling the projectile.

In some known embodiments, a training device may be used to enable players to practice propelling the projectile. At least some known training devices merely facilitate improving the player's accuracy by instructing the player to propel the projectile towards a predetermined set of targets. Such embodiments do not facilitate increasing the player's reaction time in deciding which target option to propel the object towards.

BRIEF DESCRIPTION OF THE INVENTION

In one exemplary embodiment, a method of conveying a command to a user using a practice system is provided. The method includes detecting movement of the user using a sensor; selecting a command from a list of pre-determined commands; and conveying the command to the user using a signaler.

In another exemplary embodiment, a command generating device is provided. The device includes a signaler; a sensor; and a circuit board, the signaler and the sensor are each electronically coupled to the circuit board, the sensor facilitates detecting motion of a user and the signaler facilitates conveying a command to the user.

In yet another exemplary embodiment, a practice system is provided. The practice system includes a housing comprising a cavity defined therein; and a command generating device coupled to the housing and positioned within the cavity, the command generating device comprising a signaler; a sensor; and a circuit board, the signaler and the sensor are each electrically coupled to the circuit board, the sensor facilitates detecting motion of a user and the signaler facilitates conveying a command to the user.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
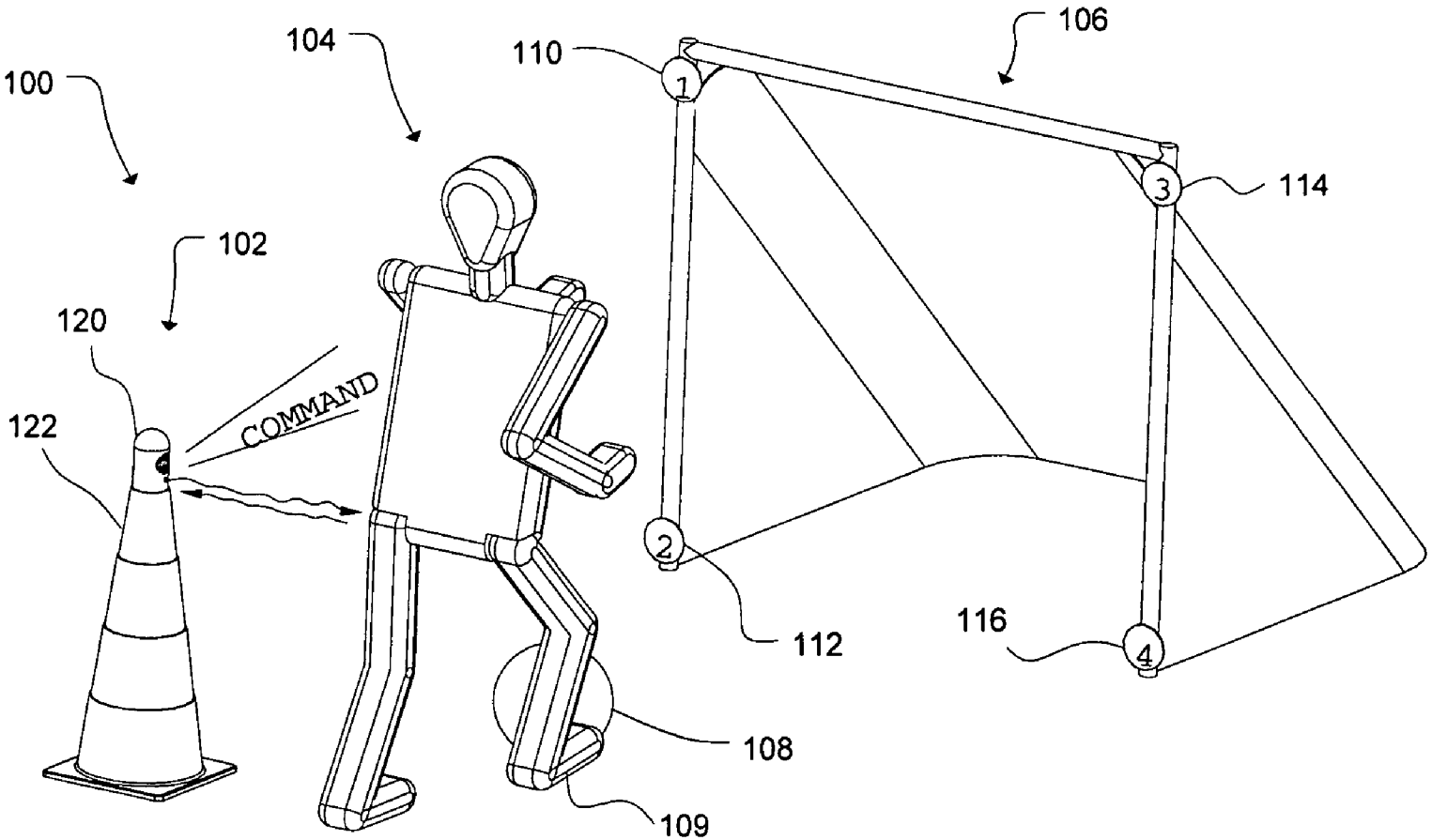
FIG. 1 is a perspective view of an exemplary practice system.
Figure 2:
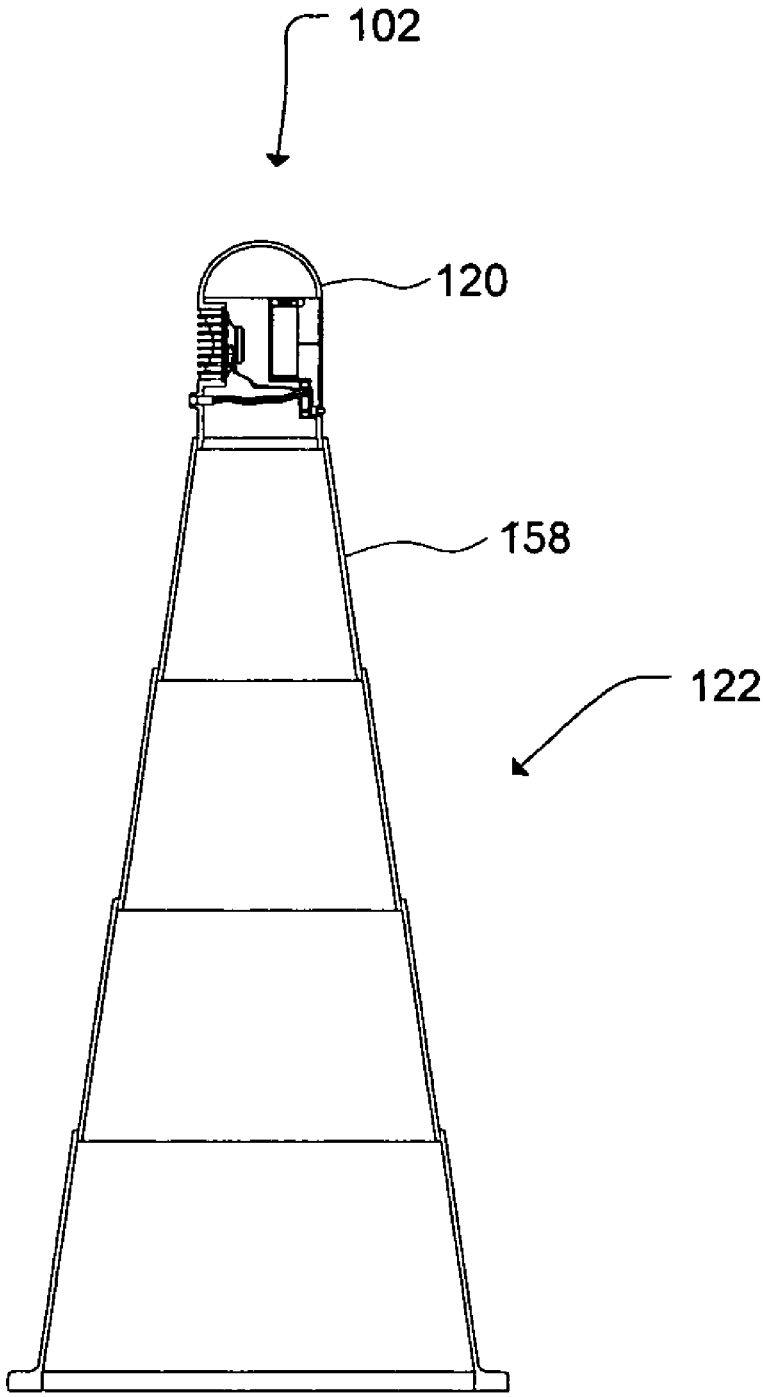
FIG. 2 is a cross-sectional side view of a command station that may be used with the system shown in FIG. 1.
Figure 3:
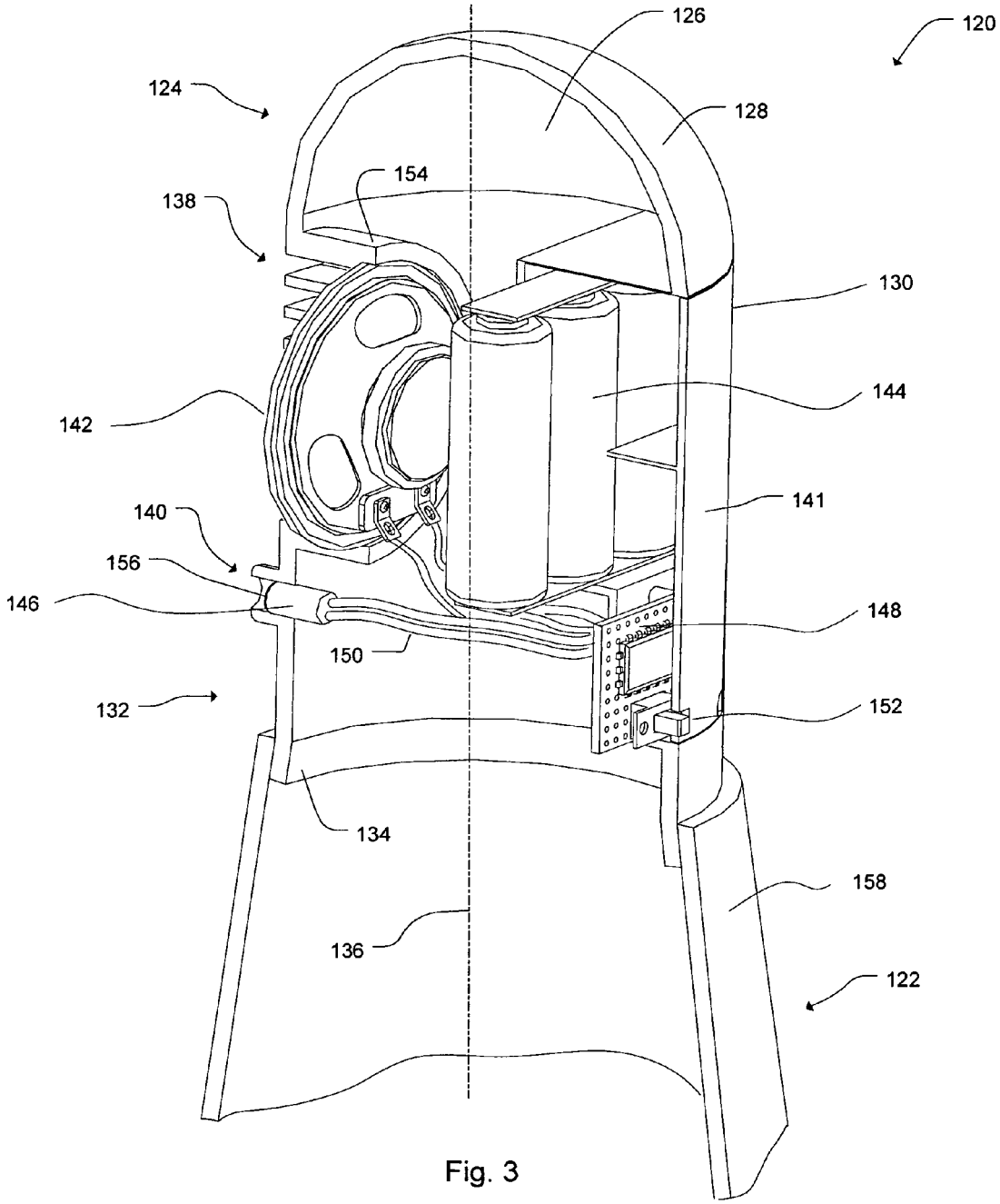
FIG. 3 is a perspective view of a cross-section of the command station that may be used with the system shown in FIG. 1.

FIG. 1 is a perspective view of a practice system 100. FIG. 2 is a cross-sectional side view of a command station 102. FIG. 3 is a perspective view of a cross-section of command station 102. In the exemplary embodiment, system 100 may include at least one command station 102, at least one user 104, at least one receiver 106 and at least one projectile 108. In one embodiment, user 104 may be a player participating in a practice scenario. In another embodiment, user 104 may be any person desiring to improve their reaction time and accuracy in propelling projectile 108. In yet another embodiment, the practice scenario may include, but not limited to, an athletic sport practice such as, but not limited to, soccer, hockey, lacrosse, field hockey, football, basketball, baseball, rugby, softball and/or water polo. In the exemplary embodiment, projectile 108 may be a ball. Alternatively, projectile 108 may include, but not limited to, a puck, a flying disk and/or any other hard or inflatable object. In the exemplary embodiment, receiver 106 may be a goal. Alternatively, receiver 106 may be an object such as, but not limited to, a net, a basket, a backstop, an end-zone and/or a target. In another embodiment, receiver 106 may be another user 104. In the exemplary embodiment, user 104 may propel projectile 108 using a foot 109 of user 104. Alternatively, user 104 may propel projectile 108 using any part of their body including, but not limited to, a hand, an arm, a head, a chest or a knee. In another embodiment, user 104 may propel projectile 108 using any type of athletic equipment or propelling device such as, but not limited to, a bat, a racket, a hockey stick or a lacrosse stick.

In the exemplary embodiment, receiver 106 may include a plurality of sub-target options to which user 104 may propel projectile 108 towards. Specifically, receiver 106 may include a first sub-target 110, a second sub-target 112, a third sub-target 114 and a forth sub-target 116. Sub-targets 110, 112, 114 and 116 may be the corners of receiver 106. Specifically, first sub-target 110 may be an upper left corner of receiver 106, second sub-target 112 may be a lower left corner of receiver 106, third sub-target 114 may be an upper right corner of receiver 106 and forth sub-target 116 may be a lower right corner of receiver 106. In one embodiment, receiver 106 may include any number of sub-target options, wherein each sub-target option may refer to any location on receiver 106. In another embodiment, receiver 106 may not include any sub-target options such that receiver 106 is the target itself, such as, for example, a basketball hoop.

Referring to FIG. 3, command station 102, in the exemplary embodiment, may include a command generating device 120 coupled to a support structure 122. Specifically, command generating device 120 may include a housing 124 that includes a cavity 126 defined therein. More specifically, housing 124, in the exemplary embodiment, may include a substantially dome-shaped top portion 128, a substantially cylindrically-shaped body portion 130 and a substantially cylindrically-shaped bottom portion 132. Bottom portion 132 may include an annular flange 134 that extends circumferentially away from a central axis 136 and facilitates coupling command generating device 120 to support structure 122, as described in more detail below. Alternatively, command generating device 120 may be coupled to support structure 122 using any coupling means known to a person having ordinary skill in the art.

In the exemplary embodiment, housing 124 also includes a plurality of first apertures 138 defined therein such that each first aperture 138 connects cavity 126 with an area outside of housing 124. Moreover, housing 124 also includes at least one second aperture 140 defined therein such that second aperture 140 also connects cavity 126 with the area outside of housing 124. Further, housing 124 may also include an access panel 141 defined in body portion 130 that enables an operator to gain access to cavity 126.

In the exemplary embodiment, command generating device 120 may also include a signaler 142, a power source 144, a sensor 146 and a circuit board 148 coupled to housing 124 and positioned within cavity 126. As a result, housing 124 facilitates protecting the components from the outside environment. Specifically, signaler 142, sensor 146 and power source 144 are each electronically coupled to circuit board 148 using a plurality of wires 150. Moreover, an on/off switch 152 may be coupled to circuit board 148 and partially extend through housing 124 to enable the operator to turn on or off command generating device 120. In the exemplary embodiment, power source 144 may be at least one battery. Alternatively, power source 144 may be an alternating current/direct current power, solar power and/or any other type of power source known to a person having ordinary skill in the art and that enables system 100 to function as described herein.

In the exemplary embodiment, signaler 142 may be coupled to housing 124, and more specifically, to an annular mount 154 such that signaler 142 is positioned adjacent each first aperture 138. As a result, a signal generated by signaler 142 may travel from cavity 126 to the area outside housing 124, and more specifically user 104, using the plurality of first apertures 138. In one embodiment, signaler 142 may be a speaker to facilitate generating and conveying an audible signal to user 104. In another embodiment, signaler 142 may be a light source or any other type of signal source that enables system 100 to function as described herein. In the exemplary embodiment, sensor 146 may be coupled within second aperture 140 and extend partially therethrough such that a sensing end 156 of sensor 146 is oriented to face towards the area outside housing 124.

In the exemplary embodiment, support structure 122 may be extendable and/or adjustable. Specifically, support structure 122 may include a plurality of conical-shaped body segments 158 that each may include a circular-shaped cross-section. In one embodiment, the plurality of body segments 158 may include a rectangular, a triangular, a square or an oval cross-sectional shape. In another embodiment, support structure 122 may include any cross-sectional shape that enables system 100 to function as described herein. In the exemplary embodiment, each body segment 158 may overlap at least one adjacent body segment 158 such that the plurality of conical-shaped body segments 158 may telescope inward or outward in a direction substantially parallel to central axis 136. Specifically, support structure 122 may extend telescopically from a compacted position (not shown) to an extended position (shown in FIG. 2). A last body segment 158 may overlap annular flange 134 to facilitate coupling command generating device 120 to support structure 122. In one embodiment, support structure 122 may include, but not limited to, an extendable pole and/or an extendable tripod. In another embodiment, support structure 122 may include a fixed height such that support structure 122 is not extendable. In yet another embodiment, command station 102 may not include a support structure 122. In such an embodiment, housing 124 may double as the support structure such that command station 102, and more specifically command generating device 120, may be placed directly on the ground.

Circuit board 148 may include a plurality of pre-programmed or custom commands programmed therein. Such commands may include, but not limited to, words, instructions, commands or signals. In one embodiment, the operator may program the plurality of custom commands within circuit board 148 such that system 100 may randomly select one of the custom commands from the list of custom commands in the event sensor 146 detects motion, as described in more detail below. In yet another embodiment, circuit board 148 may include a timer (not shown) programmed therein, as described in more detail below. In such an embodiment, the timer may be programmable by the operator, as described in more detail below.

User 104 may utilize practice system 100 during any type of practice session to facilitate improving user's 104 reaction time and accuracy of propelling projectile 108. In the exemplary embodiment, practice system 100 may be used in any type of athletic session. For example, a non-limiting example pertaining to soccer practice training is used herein to describe the operation of system 100. During operation of one embodiment of the non-limiting soccer example, at least one command station 102 may be used during the practice session to facilitate improving the reaction time and accuracy of at least one user 104, or player, in propelling projectile 108, or ball, towards receiver 106, or goal. Specifically, at least one command station 102 may be placed at some location on a practice filed where player 104 may be required to make a substantially immediate decision to propel ball 108 towards one of a plurality of target options located on goal 106. Specifically, player 104 may be required to quickly decide which one of sub-targets 110, 112, 114 and 116 on goal 106 to shoot ball 108 towards. More specifically, command station 102 may be placed substantially near goal 106. During operation, player 104 may start dribbling ball 108 downfield towards goal 106, and more specifically, towards command station 102. As player 104 passes command station 102, command generating device 120 may sense the motion of player 104, randomly select a command from a list of pre-determined commands and convey that command to player 104 as an audible signal using signaler. As such, player 104 may be required to shoot ball 108 towards one of sub-targets 110, 112, 114 or 116 to which the audible command refers.

In the exemplary embodiment, the audible command may be a number or any other command that enables system 100 to function as described herein. Specifically, the audible signal may refer to first sub-target 110 of goal 106. Upon hearing the audible command, player 104 may be forced to react to the command and shoot ball 108 towards the corresponding sub-target. As a result, player 104 may be required to adjust their shot at the last moment in order to follow the command relayed by command station 102. As such, the reaction time of player 104 to the command and the accuracy of the shot by player 104 are tested. As a result, system 100 facilitates improving player's 104 reaction time and accuracy of propelling ball 108 towards receiver 106 by simulating game-like situations.

During operation of another embodiment of the non-limiting soccer example, a plurality of command stations 102 may be used during the practice session to facilitate improving the reaction time and accuracy of at least one player 104 in propelling ball 108 towards at least one receiver 106, wherein each receiver 106 may be another player 104. In such an embodiment, a first command station 102 may be placed at a first position on the field and a second command station 102 may be placed at a second position on the field. In such an embodiment, first command station 102 may be placed at some location on the field away from goal 106 and second command station 102 may be placed on the field substantially near goal 106, as described above. During operation, a first player 104 may start dribbling ball 108 downfield towards goal 106, and more specifically, towards first command station 102. As the first player 104 passes the first command module 102, command generating device 120 may sense the motion of the first player 104, randomly select a command from a list of pre-determined commands and convey that command to first player 104 as an audible signal using signaler 142. The audible command may be a number or any other command that enables system 100 to function as described herein. Specifically, the audible command may refer to another player 104. As a result, player 104 may be required to pass ball 108 to a specific second player 104 out of a plurality of other players 104. Upon receiving the instruction of which other player to pass it to, the first player 104 reacts to the command by passing ball 108 to the identified second player 104. The second player 104, upon receiving ball 108 from the first player 104, may dribble ball 108 towards goal 106, and more specifically, the second command station 102. As the second player 104 passes the second command station 102, command generating device 120 may sense the motion of the second player 104, randomly select a command from a list of pre-determined commands and convey that command to the second player 104 as an audible signal using signaler 142. As such, the second player 104 may be required to shoot ball 108 towards one of sub-targets 110, 112, 114 or 116 to which the audible command refers, as described above.

As a result, each player 104 may be required to adjust their shot or pass at the last moment in order to follow the command relayed by each command station 102. As such, the reaction time of each player 104 to the command and the accuracy of the shot or pass by player 104 are tested. As a result, system 100 facilitates improving each player's 104 reaction time and accuracy of propelling ball 108 towards receiver 106 by simulating game-like situations.

During operation of yet another embodiment of the non-limiting soccer example, at least one command station 102 may be used during the practice session, as described above. In the exemplary embodiment, after player 104 passes command station 102 and command station 102 detects the movement of player 104, randomly selects a command from a list of pre-determined commands and conveys that command to player 104 using signaler 142, command generating device 120 may activate the timer programmed within circuit board 148. Specifically, the timer may include a pre-set time or a custom time programmed by the operator. Upon expiration of the time set within the timer, command station 102 may select a second command from the list of pre-determined commands and convey that second command to player 104 using signaler 142.

During operation of another embodiment of the non-limiting soccer example, at least one command station 102 may be used to facilitate improving the reaction time of a goalie (not shown). In the exemplary embodiment, command station 102 may be placed substantially near goal 106, and more specifically, the goalie. Specifically, command station 102 may be initiated by detecting an initial movement of the goalie. Then, system 100 may randomly select a command from a list of pre-determined commands and convey that command to the goalie using signaler 142. As such, the goalie may be required to move, or guard, one of sub-targets 110, 112, 114 or 116 to which the audible command refers. In one embodiment, the timer may be activated after the initial movement of the goalie and programmed to trigger another command after the expiration of the time set within the timer. As a result, movements of the goalie after the initiating movement may be ignored by system 100. In an alternative embodiment, a user, such as, but not limited to, a coach or another player, may trigger system 100 with their movements to facilitate training the goalie, as described above. As such, the reaction time of the goalie to the command is tested. As a result, system 100 facilitates improving the goalie's reaction time of defending goal 106.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method of conveying a command to a user using a practice system, said method implemented on a circuit board programmable to perform the steps comprising:

detecting movement of the user using a sensor;

randomly selecting a command from a list of pre-determined commands;

conveying the command to the user using a signaler;

instructing the user to propel a projectile towards a target corresponding to the command conveyed by the signaler;

activating a timer after said step of conveying the command to the user;

selecting a second command from the list of pre-determined commands; and conveying the second command to the user using the signaler upon expiration of the timer.

2. A method in accordance with claim 1, wherein conveying the command to the user using a signaler further comprises generating an audible signal using the signaler.

3. A practice system comprising:

a housing comprising a cavity defined therein; and a randomly selected command generating device coupled to said housing and positioned within said cavity, said command generating device comprising:

a signaler;

a sensor;

a circuit board, said signaler and said sensor are each electrically coupled to said circuit board, said sensor facilitates detecting motion of a user and said signaler facilitates conveying a command to the user; and wherein said signaler comprises a speaker to facilitate conveying an audible command to the user, said audible command facilitates instructing the user to propel an object towards a receiver.

4. A practice system in accordance with claim 3 further comprising a support structure coupled to said housing.

5. A practice system in accordance with claim 4, wherein said support structure further comprises at least one of an adjustable and an extendable support portion.

6. A practice system in accordance with claim 3, wherein said circuit board further comprises a plurality of pre-determined commands programmed therein.

7. A practice system in accordance with claim 3, wherein said circuit board is programmable and further comprises a plurality of custom commands programmed therein by the user.

8. A practice system in accordance with claim 3 further comprising a power source electronically coupled to said circuit board.

9. A practice system in accordance with claim 3 further comprising an on/off switch electrically coupled to said circuit board.

10. A practice system in accordance with claim 3, wherein said circuit board further comprises a timer programmed therein.

* * * * *